United States Patent [19]

Engel et al.

[11] Patent Number: 5,057,206

[45] Date of Patent: Oct. 15, 1991

[54] PROCESS FOR THE PRODUCTION OF WHITE OILS

[75] Inventors: Dusan J. Engel, Des Plaines; Bipin V. Vora, Darien, both of Ill.

[73] Assignee: UOP, Des Plaines, Ill.

[21] Appl. No.: 236,437

[22] Filed: Aug. 25, 1988

[51] Int. Cl.[5] ..... C10G 45/00

[52] U.S. Cl. ..... 208/143; 208/58; 208/89; 585/269; 585/323

[58] Field of Search ..... 208/58, 89, 14, 18, 208/143; 585/323, 269

[56] References Cited

U.S. PATENT DOCUMENTS

| | | | |
|---|---|---|---|
| 3,259,589 | 7/1966 | Michalko | 252/466 |
| 3,340,181 | 9/1967 | Diringer et al. | 208/210 |
| 3,388,077 | 6/1968 | Hoekstra | 252/466 |
| 3,392,112 | 7/1968 | Bercik et al. | 208/210 |
| 3,431,198 | 3/1969 | Rausch | 208/143 |
| 3,459,656 | 8/1969 | Rausch | 208/57 |
| 3,529,029 | 9/1978 | Pollitzer | 260/667 |
| 3,629,096 | 12/1971 | Divijak, Jr. | 208/14 |
| 3,705,093 | 12/1972 | Ashcraft, Jr. | 208/14 |
| 4,101,599 | 7/1978 | Debande et al. | 260/683.9 |
| 4,218,308 | 8/1980 | Itoh et al. | 208/143 |
| 4,251,347 | 2/1981 | Rausch et al. | 208/57 |
| 4,431,750 | 2/1984 | McGinnis | 502/329 |
| 4,961,838 | 10/1990 | Llovera | 208/91 |

FOREIGN PATENT DOCUMENTS

| | | | |
|---|---|---|---|
| 815069 | 6/1969 | Canada | 208/143 |
| 1310320 | 3/1973 | United Kingdom . | |

*Primary Examiner*—Curtis R. Davis

*Attorney, Agent, or Firm*—Thomas K. McBride; John F. Spears, Jr.

[57] ABSTRACT

A white oil product is produced by hydrogenating a hydrocarbon stream produced from an aromatic alkylation process. The hydrogenation occurs at hydrogenation conditions in the presence of a catalyst comprising a platinum group metal component surface impregnated on a refractory oxide catalyst support. The platinum group metal component is surface impregnated such that the platinum group metal is essentially all located with a 100 micron layer of the surface of the catalyst support.

11 Claims, 2 Drawing Sheets

PROCESS FOR THE PRODUCTION OF WHITE OILS

BACKGROUND OF THE INVENTION

This invention is related to the broad field of hydrocarbon conversion. The invention may also broadly be considered to be related to a process for the production of white oils from a feedstock originating from an aromatic alkylation hydrocarbon conversion process. More specifically, the process relates to the production of white oils by hydrogenating a heavy alkylate feedstock possessing hydrogenatable components. The hydrogenation process utilizes as feedstock the heavy hydrogenatable by-product stream of an aromatic alkylation process. The hydrogenation occurs in the presence of a catalyst comprising a platinum group metal on a refractory oxide support. The platinum group metal is preferably surface impregnated upon the support. The improvement is achieved through the upgrading of the heavy hydrogenatable by-product stream of an aromatic alkylation reaction into a more valuable white oil product in the presence of the catalyst described above.

INFORMATION DISCLOSURE

The production of hydrocarbon white oils from a hydrocarbon feedstock is a well established process. Unlike the instant process, most processes disclosed in the prior art for the production of white oils are two-step processes. In the two-step processes, the first step typically is to react a feedstock in the presence of hydrogen to remove sulfur and nitrogen compounds therefrom; and the second step is a hydrogenation step. Such a process is disclosed in U.S. Pat. No. 3,392,112. The '112 patent discloses the use of a two-stage process to convert sulfur-containing hydrocarbon feedstocks into white oils. One of the feedstocks mentioned in the '112 patent is an alkylate fraction boiling above the gasoline range with the alkylate being mentioned as being useful as a lighter fluid following dehydrogenation as opposed to a white oil. Additionally, the process of this invention is distinguished from that of the '112 patent in that the instant process is a single stage process which hydrogenates a heavy alkylate feedstock containing essentially no sulfur and having substantially higher boiling range than the light alkylate fraction disclosed in the '112 patent. Thus, the two processes are dissimilar.

Two-stage processes for the hydrogenation of hydrocarbons are disclosed in U.S. Pat. Nos. 3,431,198, 3,459,656, 3,340,181, 4,251,347 along with British Patent 1,310,320. The processes disclosed in each of these patents comprises a first reaction zone containing a sulfur-resistant catalyst and a second reaction zone comprising a catalyst similar to the instant catalyst. However, since the feedstock of the instant process is a $C_{15}$–$C_{50}$ aromatic alkylation reaction product, there will be essentially no sulfur present in the hydrocarbon feedstock to this process. Therefore, a two-stage process and related rigorous reaction conditions are not necessary.

U.S. Pat. No. 4,218,308 discloses a process for the production of a white oil in a single stage hydrogenation process using a catalyst comprising silica-alumina. The catalyst of the process of this invention comprises alumina only, with no silica, to reduce hydrocracking and is thus distinguished from the '308 patent.

A process for the hydrogenation of a liquid olefinic polymer derived from olefin units containing 4 carbon numbers to produce a white oil product is disclosed in U.S. Pat. No. 4,101,599. The hydrogenation occurs in the presence of a catalyst comprised of palladium on an alumina support having a specific pore volume distribution. The primary distinction between the process of the '599 patent and this invention is the difference in the feedstocks employed and in the products produced. That is, the white oil of the '599 process will comprise paraffinic white oil while that of the instant invention will comprise cyclic and paraffinic white oils.

A process for producing a cycloparaffinic hydrocarbon in part by hydrogenating benzene is disclosed in U.S. Pat. No. 3,529,029. The catalyst and operating conditions disclosed in the '029 process are similar to that of the process of the instant invention. However, the '029 patent is directed primarily towards the production of individual light cycloparaffinic hydrocarbons such as cyclohexane while the process disclosed herein is directed towards the production of hydrocarbon white oils comprising cycloparaffins, paraffins, and other saturated hydrocarbons.

The production of uniform layer-impregnated catalysts and their use in hydrocarbon conversion processes are disclosed in U.S. Pat. Nos. 3,259,589, 3,388,077, and 3,651,167. Both the '589 and '077 patents describe the production of a catalyst comprising a platinum group component that is located in a uniform layer within the catalyst particle. However, the platinum component of the catalyst of the '589 and '077 patents is not surface impregnated, it is impregnated in a uniform layer at a point below the surface of the particle.

The '167 disclosure mentioned above discloses a selective hydrogenation process which a catalyst comprising a surface-impregnated platinum group metal shell. Because the catalyst above is utilized in the selective hydrogenation of acetylene and butadiene, it would be unobvious to use the catalyst of the '167 disclosure in the hydrogenation of a heavy alkylaromatic compounds such as is done in the instant process.

BRIEF SUMMARY OF THE INVENTION

This invention provides a process for the production of a valuable white oil hydrocarbon product from the low value hydrocarbon by-product stream of an aromatic alkylation process. The instant process is a hydrogenation process which is able to produce a white oil product in a single reaction step utilizing a specific hydrogenation catalyst. The catalyst useful in the process comprises a platinum group metal on an alumina support. The process disclosed is able to produce a high quality white oil product containing minimal by-products and unreacted aromatic components.

In a broad embodiment, this invention is a process for producing a hydrocarbon white oil from a $C_{15}$–$C_{50}$ hydrocarbon feedstock obtained from an aromatic alkylation process. The white oil product is produced by contacting the $C_{15}$–$C_{50}$ hydrocarbons with a hydrogenation catalyst comprising a platinum group metal component on an alumina support in a hydrogenation reaction zone operating at hydrogenation reaction conditions. The white oil product of the hydrogenation reaction zone is then recovered. In a more specific embodiment, the hydrogenation process of this invention utilizes a hydrocarbon feed stream comprising $C_{15}$–$C_{50}$ hydrocarbons obtained from an aromatic alkylation process of which 70–100 wt. % of the $C_{15}$–$C_{50}$ hydrocarbons are alkylaromatic hydrocarbons and 0–30 wt.

% of the $C_{15}$–$C_{50}$ hydrocarbons are paraffinic, and 0–30 wt. % olefinic and naphthenic hydrocarbons. The hydrocarbon feedstock is contacted in a hydrogenation reaction zone with a hydrogenation catalyst comprising from 0.05 to 5.0 wt. % of a surface-impregnated platinum component and additionally and optionally from 0.1 to 5.0 wt. % of a lithium, sodium, or potassium component on a gamma-alumina support particle. The surface-impregnated platinum is located on the gamma-alumina particle in such a manner that the platinum concentration on the outer 25 vol. % of the gamma-alumina catalyst particle is at least twice that of the platinum concentration in the inner 25 vol. % of the gamma-alumina catalyst particle. The hydrocarbon feedstock is contacted with the catalyst at hydrogenation reaction conditions including a temperature of from about 125° to 300° C., a pressure of from 10 to 136 atmospheres, a liquid hourly space velocity of from 0.1 to 5.0 $hr^{-1}$, and at a hydrogen-to-hydrocarbon molar feed ratio of from 2 to 15. The white oil product of the hydrogenation reaction zone is then recovered.

DETAILED DESCRIPTION

Figure 1:
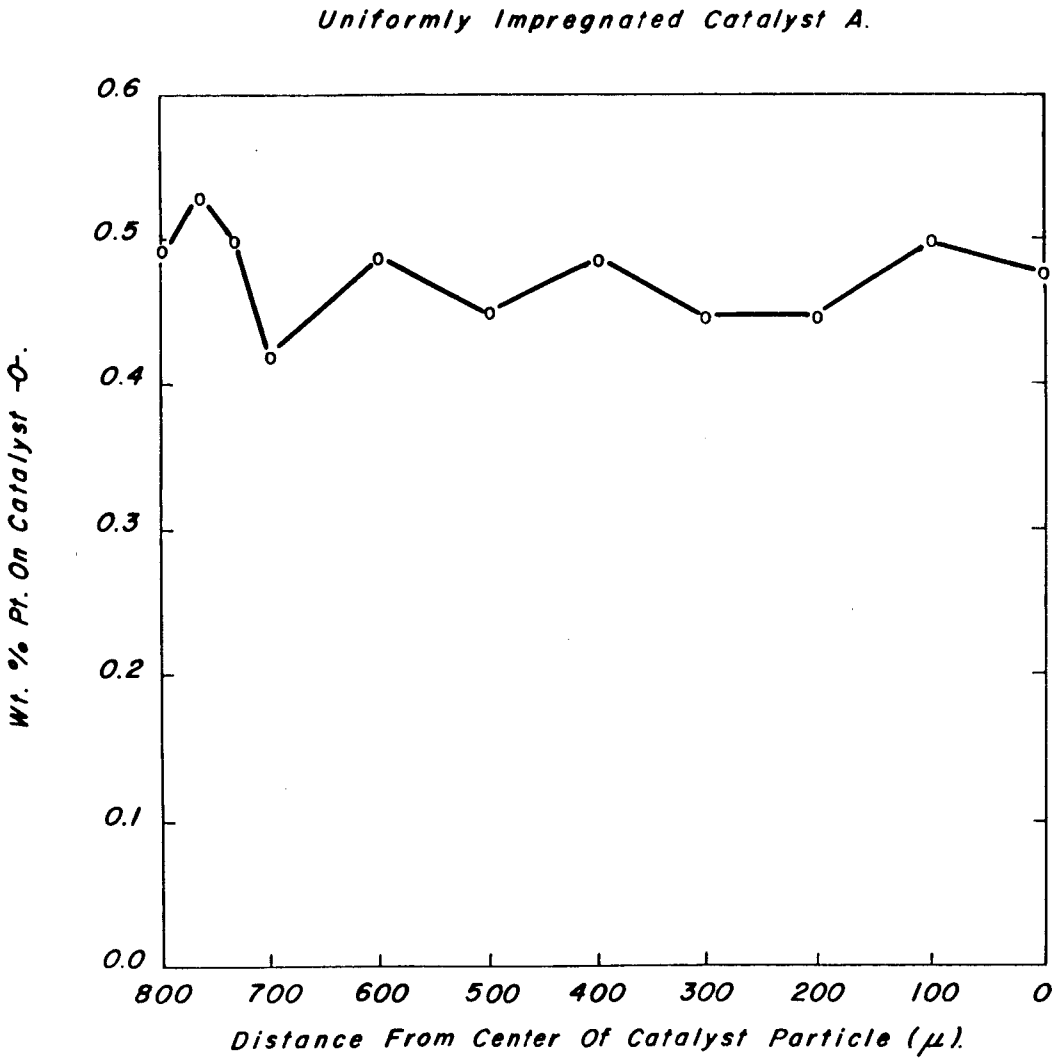
FIG. 1 is a plot of the distribution of platinum along the radius of a gamma-alumina catalyst particle uniformly impregnated with platinum (Catalyst A). The catalyst particle has a radius of 1,000 microns. The platinum distribution within the catalyst particle was determined by energy dispersive X-ray spectroscopy (EDX). The EDX test was performed on three separate catalyst particles with the results in FIG. 1 being an average of the three analyses. Therefore, the resulting platinum distribution should be representative of the entire batch of catalyst prepared by the method disclosed herein.

The production of a valuable hydrocarbon white oil product from a $C_{15}$–$C_{50}$ hydrocarbon product of an aromatic alkylation process is the object of this invention. More particularly, the process of this invention is directed towards the hydrogenation of a heavy alkylate by-product stream in a hydrogenation reaction zone in the presence of a hydrogenation catalyst comprising platinum on an alumina support all at hydrogenation reaction conditions.

Conventional refining techniques, for example, HF alkylation, selective hydrogenation, and the like, have been combined, modified, and improved in order to reduce the amount of low value heavy alkylate by-products of an aromatic alkylation process. However, even with these improvements, there is still a small but significant amount of heavy alkylate by-product which must be disposed of from an aromatic alkylation process. Thus, there is a great need for a simple method of eliminating the production of a heavy alkylate by-product of an alkylation process.

The present invention satisfies this need by presenting a process which is capable of hydrogenating a $C_{15}$–$C_{50}$ hydrocarbon such as a heavy alkylate to produce a valuable white oil product. According to the process of the present invention, a white oil product characterized as being essentially absent of aromatics or olefins is produced by hydrogenating a $C_{15}$–$C_{50}$ hydrogenatable hydrocarbon feedstock. The feedstock hydrogenated is characterized in that it is produced as a product or by-product of an aromatic alkylation process. The hydrogenation catalyst is characterized in that it comprises a platinum metal component on an alumina support. The platinum metal component is preferably surface impregnated upon the support and may contain other modifier components such as an alkali metal component.

White oils are highly refined oils derived from petroleum which have been extensively treated to virtually eliminate oxygen, nitrogen, sulfur compounds and reactive hydrocarbons such as aromatic hydrocarbons. White oils fall into two classes, i.e., technical white oils which are used in plastics, polishes, paper industry, textile lubrication, insecticide base oils, etc., and the even more highly refined pharmaceutical white oils which are used in drug compositions, cosmetics, foods, and for the lubrication of food handling machinery. For all of these applications, white oils must be chemically inert and without color, odor, and taste. Therefore, white oils must be essentially absent of reactive species such as aromatic and olefinic components and must meet strict specifications. White oil specifications are rather difficult to meet. For example, such oils must have a color of +30 Saybolt, and must pass the UV Absorption Test (ASTM D-2008) which measures the amount of polynuclear aromatics in the product, and the USP Hot Acid Test (ASTM D-565). The process of the present invention is able to produce a white oil product that meets or exceeds the above specifications for both technical and pharmaceutical grade white oils.

The heavy hydrogenatable hydrocarbon that is useful as the feedstock to the hydrogenation process of this invention as mentioned is a $C_{15}$–$C_{50}$ hydrocarbon product or by-product of an aromatic alkylation process. The useful heavy hydrogenatable hydrocarbon feedstock as the name implies must comprise hydrogenatable components. Such components include, but are not limited to, aromatics, polynuclear aromatics, and olefins. Other characteristics of the feedstock include a specific gravity of from 0.80 to 0.90, a kinematic viscosity of from 10 to 400 centistokes at 37.8° C., and a boiling point range of from 200°–650° C. The useful $C_{15}$–$C_{50}$ hydrocarbon feed to the hydrogenation process of this invention is further characterized in that it comprises from 70–100% by weight alkylaromatic components, from 0–30% by weight paraffinic components, and from 0–30 wt. % olefins and naphthenes. The term "alkylate" has two distinct meanings which are applied by different groups of specialists to different chemical species. In the petroleum processing field, the term alkylate is understood to refer to a branched-chain paraffin produced by the chemical reaction of a paraffin with an olefin. These paraffins possess high octane ratings and are preferred components for blending gasoline. In the detergent manufacturing field, the term alkylate denotes the chemical reaction product of benzene or one of its aromatic homologs with a longchain olefin. These alkyl benzenes are relatively biodegradable and are preferred detergent components. For the purpose of describing the present invention, the inventor has chosen to use the term "aromatic alkylation" to emphasize that this invention is specifically directed to processing alkylates comprising alkyl benzenes such as those commonly produced within the detergent manufacturing industry.

Support for this addition to the specification may be found in claim 1 which is specifically directed to a feed stream obtained from an aromatic alkylation process. This addition defines the term "aromatic alkylation" in a way that is consistent with its usage by skilled artisans. This addition adds no new subject matter.

It is an important aspect of this invention that the heavy hydrogenatable hydrocarbon feedstock is essentially free of sulfur and nitrogen. These elements can detrimentally affect the hydrogenation zone catalyst. By "essentially free", it is meant that the feedstock contains less than 10 ppm of either sulfur or nitrogen.

The heavy hydrogenatable hydrocarbon described above is hydrogenated in a hydrogenation reaction zone containing a hydrogenation catalyst. The hydrogenation catalyst of this invention comprises a platinum group metal component on an alumina support. The useful platinum group metals are ruthenium, palladium, rhodium, osmium, iridium, and platinum.

A particularly preferred hydrogenation catalyst comprises from 0.05 to 5.0 wt. % of platinum or palladium combined with a non-acidic refractory inorganic oxide material such as alumina. While the precise manner by which the catalytic composite is prepared is not an essential feature of the catalyst of the present invention, superior hydrogenation performance is observed when utilizing a catalyst in which the catalytically active platinum group noble metal is surface impregnated. This type of catalyst results in a white oil product with superior properties and fewer impurities than white oil produced by hydrogenation processes using catalysts which have been bulk-impregnated, or thoroughly impregnated within and throughout the carrier material with a platinum group metal component.

It is preferred that the platinum group metal component be present in the catalytic composite in an amount ranging from 0.05 to 3.0 wt. %. Further, it is anticipated that other catalytically active components such as alkali, or alkaline, elements or halogens and the like known catalytic components may be usefully incorporated into the instant catalyst.

The preferred catalyst of this invention may be prepared by any method described in the prior art for forming a catalyst base comprising alumina and incorporating a platinum group metal component into the base. The preferred alumina carrier material may be prepared in any suitable manner and may be synthetically prepared or naturally occurring. The alumina used may be in various forms such as alpha-alumina, gamma-alumina, theta-alumina, and the like with gamma-alumina being preferred. Whatever type of alumina is employed, it may be activated prior to use by one or more treatments including drying, calcination, steaming, etc., and it may be in a form known as activated alumina, activated alumina of commerce, porous alumina, alumina gel, etc. For example, the alumina carrier may be prepared by adding a suitable alkaline reagent, such as ammonium hydroxide to a solution of a salt of aluminum such as aluminum chloride, aluminum nitrate, etc., in an amount to form an aluminum hydroxide gel which upon drying and calcining is converted to alumina. The alumina carrier may be formed in any desired shape such as spheres, pills, cakes, extrudates, powders, granules, etc., and utilized in any desired size. For the purpose of the present invention, a particularly preferred form of alumina is the sphere or extrudate. If an extrudate is used, it may be cylindrical or polylobular in configuration. Alumina spheres may be continuously manufactured by the well-known oil drop method which comprises: forming an alumina hydrosol by any of the techniques taught in the art and preferably by reacting aluminum metal with hydrochloric acid, combining the resulting hydrosol with a suitable gelling agent and dropping the resultant mixture into an oil bath maintained at elevated temperatures. The droplets of the mixture remain in the oil bath until they set and form hydrogel spheres. The spheres are then continuously withdrawn from the oil bath and typically subjected to specific aging treatments in oil and an ammoniacal solution to further improve their physical characteristics. The resulting aged and gelled particles are then washed and dried at a relatively low temperature of about 149° to about 204° C. and subjected to a calcination procedure at a temperature of about 454° to about 704° C. for a period of about 1 to about 20 hours. It is also a good practice to subject the calcined particles to a high temperature steam treatment in order to remove as much of the undesired acidic components as possible. This manufacturing procedure effects conversion of the alumina hydrogel to the corresponding preferred crystalline gamma-alumina form of alumina. See the teachings of U.S. Pat. No. 2,620,314 for additional details.

A preferred constituent for the catalystic composite used as the hydrogenation catalyst of the present invention is a platinum group metal component. The platinum group metal component such as platinum may exist within the final catalytic composite as a compound such as the oxide, sulfide, halide, etc., or as an elemental metal. Generally, the amount of the platinum group metal component present in the final catalyst is small. In fact, the platinum group metal component generally comprises about 0.05 to about 5 percent by weight of the final catalytic composite calculated on an elemental basis. Excellent results are obtained when the catalyst contains about 0.1 to about 1 wt. % of the platinum group metal. The preferred platinum group component is platinum, or palladium, with platinum being most preferred.

The platinum group metal component may be incorporated in the catalytic composite in any suitable manner such as coprecipitation or cogelation with the carrier material, ion-exchange with the carrier material and/or hydrogel, or impregnation either after or before calcination of the carrier material, etc. A method of preparing the catalyst involves the utilization of a soluble, decomposable compound of the platinum group metal to impregnate the porous carrier material. For example, the platinum group metal may be added to the carrier by commingling the latter with an aqueous solution of chloroplatinic acid. Other water-soluble compounds of the platinum group metals may be employed in impregnation solutions and include ammonium chloroplatinate, bromoplatinic acid, platinum chloride, dinitrodiaminoplatinum, palladium chloride, palladium nitrate, palladium sulfate, diamine palladium hydroxide, tetraminepalladium chloride, etc. The utilization of a platinum chloride compound such as chloroplatinic acid is ordinarily preferred. In addition, it is generally preferred to impregnate the carrier material after it has been calcined in order to minimize the risk of washing away the valuable platinum metal compounds; however, in some cases, it may be advantageous to impregnate the carrier when it is in a gelled state.

A preferred feature of the catalyst of the present invention is that a platinum group metal component is surface impregnated upon the catalytic support material such that the concentration of the platinum group metal component on the outer 25 vol. % of the catalyst particle is at least twice as great as the concentration of the platinum group metal component on the inner 25 vol. % of the catalyst particle.

The outer and inner volume percent both refer to a portion of the particle having a uniform layer. That is to say that in the case of a spherical or cylindrical catalyst particle, the outer 25 vol. % would circumscribe the area of the particle a distance (r) from the center of the particle to the maximum radius (r max) of the particle which comprises the outermost 25 vol. % of the particle. The inner 25 vol. % of the particle would be circumscribed by a uniform radius from the center of the particle which would comprise the innermost or first 25 vol. % of the particle.

In the case of a catalyst particle without a uniform shape or diameter, the nominal diameters or nominal distance from the center of the particle to the points where 25% and 75% of the particle volume lie should be used to define such a surface impregnated catalyst. Since this is obviously a difficult determination, the catalyst particles are preferably uniform, spherical or cylindrical extrudates.

In addition to the surface-impregnated platinum group component, a surface-impregnated or uniformly dispersed modifier metal component may also be an aspect of this invention. That is to say that the concentration of the modifier metal component if used may be essentially the same across the entire diameter of the catalyst particle or alternatively be surface impregnated in a manner similar to that of the platinum group metal component.

The characterization of the catalytic composite is intended to describe a platinum group metal concentration gradient upon and within the catalyst support. The concentration of the platinum group component within the first 25 vol. % of the support particle is as stated at least twice that of the platinum group component concentration within the 25 vol. % inner diameter of the catalyst. The surface-impregnated metal concentration thus tapers off as the center of the support is approached. The actual gradient of the platinum group metal component within the catalyst support varies depending upon the exact manufacturing method employed to fabricate the catalyst. However, it is desired to place as much of the surface-impregnated platinum group metal upon the outer 25 vol. % of the catalyst particle as possible so the expensive metal component can be efficiently used in the hydrogenation process.

Although "surface-impregnated" catalysts have achieved an individual status in the art, and further are considered unique by those possessing expertise in the realm of catalysis, the merit thereof for the hydrogenation of $C_{15}$–$C_{50}$ hydrogenatable hydrocarbons is not recognized. While it is not understood completely, it is believed that by restricting substantially all of the surface-impregnated platinum group metal component to the outer 25 vol. % layer of the catalyst support, more facile access to these catalytic sites is achieved, allowing the hydrocarbon reactants and products much shorter diffusion paths. By decreasing the length of the diffusion paths, the reactants and products have a shorter residence time in the presence of catalytically active sites on the particle, thereby reducing the likelihood of undesirable secondary reactions. This results in an increase in conversion and selectivity to the desired product.

The platinum group component may be surface impregnated via the formulation of a chemical complex of the platinum group component. The complex formed is strongly attracted to the refractory oxide support and this strong attraction results in the complex which contains a platinum group metal being retained primarily upon the outer surface of the catalyst.

Any compound that is known to complex with the desired platinum group component and with the metal component of the refractory oxide support is useful in the preparation of the surface-impregnated catalyst of the present invention. However, it has been found that a multi-dentated ligand is very useful in complexing with a platinum group metal and the refractory oxide support resulting in the surface impregnation of the platinum group metal. Multi-dentated ligands are compounds that contain more than one appendage that can bond strongly to the oxide support. Such appendages would typicall comprise carboxylic acids, amino groups, thiol groups, phosphorus groups, or other strongly polar groups of chemical components. It is also an aspect of this invention that the multi-dentated ligand contains: a functional group such as —SH or $PR_2$ (where R is a hydrocarbon) that has a high affinity towards the platinum group metal component and a second functional group comprising a carboxylic acid or the like component that can be strongly adsorbed onto the metal oxide support.

This preferred property of the multi-dentated ligand effectively insures that the platinum group metal component does not penetrate the catalyst particle by binding strongly with the platinum group metal while also binding to the support quickly and strongly. Examples of some useful multi-dentated ligands include thiomalic acid, thiolactic acid, mercapto propionic acid, thiodiacetic acid, thioglycollic acid, and thioproponic acid among others.

The preferred multi-dentated ligand of the instant invention is thiomalic acid. The thiomalic acid, the platinum group metal, and the catalyst base can be combined in a number of ways which result in the surface impregnation of the catalyst base with the platinum group metal. In one method, thiomalic acid and a platinum group metal are allowed to complex in a solution before introduction of a catalyst base to the solution. The complex containing solution is evaporated with the complex containing the platinum group metal remaining on the outside layer of the catalyst particle resulting in the surface impregnation of the platinum group metal.

In an alternative method, the refractory oxide support is allowed to contact a solution containing thiomalic acid for a time. A second solution containing a platinum group metal is then added to the mixture and the solution containing the mixture is evaporated. The platinum group metal complexes with the thiomalic acid already on the outer portion of the catalyst. This procedure also results in the surface impregnation of the platinum group metal.

Another method that results in the surface impregnation of a platinum group metal component upon a catalyst particle is a low acid or no acid impregnation. In this method, the catalyst particles are contacted with a solution containing a platinum group metal component in water alone or in a weak acid solution of about 1 wt. % or less acid. With such solutions, the platinum group metal component is less mobile and cannot easily penetrate towards the center of the catalyst particle resulting in an impregnated particle with the platinum group component largely on the outer portion of the particle. Other impregnation variables such as solution, temperature, and residence time will also affect the results of the surface impregnation step.

Typical of some of the platinum group compounds which may be employed in preparing the catalyst of the invention are chloroplatinic acid, ammonium chloroplatinate, bromoplatinic acid, platinum dichloride, platinum tetrachloride hydrate, platinum dichlorocarbonyl dichloride, dinitrodiaminoplatinum, palladium chloride, palladium chloride dihydrate, palladium nitrate, etc. Chloroplatinic acid is preferred as a source of platinum.

The platinum group component and modifier metal component may be composited with the support in any sequence. Thus, the platinum group component may be surface impregnated on the support followed by sequential uniform impregnation of one or more modifier metal components. Alternatively, the modifier metal component or components may be uniformly impregnated on the support or incorporated into the support during its formulation, followed by surface impregnation with the platinum group component. It is also contemplated that the platinum group component and modifier metal component may be surface impregnated upon a refractory oxide support throughout which the same modifier metal component is uniformly located. However, it is preferred that the modifier metal be incorporated into the catalyst during the formulation of the base and prior to the surface impregnation of the platinum group metal upon the catalyst base.

As indicated above, the present invention involves use of a catalytic composite containing an optional alkali metal component. More specifically, this component is selected from the group consisting of the compounds of the alkali metals—cesium, rubidium, potassium, sodium, and lithium. This component may exist within the catalytic composite as a relatively stable compound such as the oxide or sulfide or in combination with one or more of the other components of the composite, or in combination with an alumina carrier material such as in the form of a metal aluminate. Since, as is explained hereinafter, the composite containing the alkali metal component is always calcined in an air atmosphere before use in the conversion of hydrocarbons, the most likely state this component exists in during use in dehydrogenation is the metallic oxide. Regardless of what precise form in which it exists in the composite, the amount of this component utilized is preferably selected to provide a composite containing about 0.01 to about 10 wt. % of the alkali metal, and more preferably about 0.1 to about 5 wt. %. The optional alkali component is preferably but not necessarily uniformly distributed throughout the catalyst particle. Best results are ordinarily achieved when this component is a compound of lithium, potassium, sodium, or mixtures thereof.

This alkali metal component may be combined with the porous carrier material in any manner known to those skilled in the art such as by impregnation, coprecipitation, physical admixture, ion exchange, etc. However, the preferred procedure involves impregnation of the carrier material either before or after it is calcined and either before, during, or after the other components are added to the carrier material. Best results are ordinarily obtained when this component is added in conjunction with or after the platinum group component and modifier metal component. Typically, the impregnation of the carrier material is performed by contacting same with a solution of a suitable, decomposable compound or salt of the desired alkali metal. Hence, suitable compounds include the halides, sulfates, nitrates, acetates, carbonates, and the like compounds. For example, excellent results are obtained by impregnating the carrier material after the platinum group component has been combined therewith with an aqueous solution of lithium nitrate or potassium nitrate.

Optionally, the catalyst may contain other, additional components or mixtures thereof which act alone or in concert as catalyst modifiers to improve catalyst activity, selectivity, or stability. The catalyst modifiers are preferably but not necessarily dispersed throughout the catalyst particle in a uniform distribution. Some well-known catalyst modifiers include antimony, arsenic, bismuth, cadmium, chromium, cobalt, copper, gallium, gold, indium, iron, manganese, nickel, scandium, silver, tantalum, thallium, titanium, tungsten, uranium, zinc, and zirconium. These additional components may be added in any suitable manner to the carrier material during or after its preparation, or they may be added in any suitable manner to the catalytic composite either before, while, or after other catalytic components are incorporated.

Preferably, the catalyst of the present invention is nonacidic. "Non-acidic" in this context means that the catalyst has very little skeletal isomerization activity, that is, the catalyst converts less than 10 mole % of butene-1 to isobutylene when tested at dehydrogenation conditions and, preferably, converts less than 1 mole %. The acidity of the catalyst can be decreased if necessary to make the catalyst nonacidic by increasing the amount of the alkali component within the claimed range, or by treating the catalyst with steam to remove some of the halogen component. The acidity of the catalyst is desired to be minimized to reduce the propensity of the catalyst to promote undesirable hydrocracking type reactions. These reactions result in light component formation, which products must be removed in a product separation step.

After the catalyst components have been combined with the porous carrier material, the resulting catalyst composite will generally be dried at a temperature of from about 100° to about 320° C. for a period of typically about 1 to 24 hours or more and thereafter calcined at a temperature of about 320° to about 600° C. for a period of about 0.5 to about 10 or more hours.

It is preferred that the resultant calcined catalytic composite be subjected to a substantially water-free reduction step prior to its use in the conversion of hydrocarbons. This step is designed to insure a uniform and finely divided dispersion of the metal components throughout the carrier material. Preferably, substantially pure and dry hydrogen (i.e., less than 20 vol. ppm $H_2O$) is used as the reducing agent in this step. The reducing agent is contacted with the calcined composite at a temperature of about 427° to about 649° C. and for a period of time of about 0.5 to 10 hours or more, effective to substantially reduce at least the platinum group component. This reduction treatment may be performed in situ as part of a start-up sequence if precautions are taken to predry the plant to a substantially water-free state and if substantially water-free hydrogen is used.

According to the method of the present invention, the $C_{15}$–$C_{50}$ hydrogenatable hydrocarbon is contacted with a catalytic composite of the type described above in a hydrogenation zone at hydrogenation conditions. This contacting may be accomplished by using the catalyst in a fixed bed system, a moving bed system, a fluidized bed system, or in a batch-type operation; however, in view of the danger of attrition losses of the valuable catalyst and of well-known operational advantages, it is preferred to use a fixed bed system. In this system, the hydrocarbon feed stream is preheated if necessary by any suitable heating means to the desired reaction temperature and then passed into the hydrogenation zone containing a fixed bed of the catalyst type previously characterized. It is, of course, understood that the hydrogenation reaction zone may be one or more separate reactors with suitable heating or cooling means therebetween to insure that the desired conversion temperature is maintained at the entrance to each reactor. It is also to be noted that the reactants may be contacted with the catalyst bed in either upward, downward, or radial flow fashion. In addition, it is to be noted that the reactants may be in the liquid phase, a mixed liquid-vapor phase, or a vapor phase when they contact the catalyst, with best results obtained in the mixed phase or liquid phase.

Hydrogen is a cofeed to the hydrogenation reaction zone of this invention. Hydrogen is fed along with the $C_{15}$–$C_{50}$ hydrogenatable hydrocarbon into the reaction zone. The hydrogen-to-hydrocarbon feed mole ratio may vary from 1 to 100 with a value between 2 and 15 being preferred. Additionally, the hydrogenation of the heavy hydrogenatable hydrocarbons may occur at hydrocarbon conversion conditions including a temperature of from 125° to 300° C., a pressure of from 10 to 150 atmospheres, and a liquid hourly space velocity (calculated on the basis of the volume amount, as a liquid, of heavy hydrogenatable hydrocarbon charged to the hydrogenation zone per hour divided by the volume of the catalyst bed utilized) selected from the range of about 0.05 to about 5 $hr^{-1}$. However, the hydrogenation process conditions of this invention are typically low in severity because the hydrogenation process of the present invention is preferably accomplished with a heavy hydrogenatable hydrocarbon comprising essentially no sulfur. The most preferred hydrogenation process conditions include a temperature of from 175° to 275° C., a pressure of from 68 to 136 atmospheres, and a liquid hourly space velocity of from 0.1 to 0.5 $hr^{-1}$.

Regardless of the details concerning the operation of the hydrogenation step, an effluent stream will be withdrawn from the hydrogenation reaction zone. This effluent will comprise hydrocarbon white oils and hydrogen. This stream is passed to a separation zone wherein a hydrogen-rich vapor phase is allowed to separate from a hydrocarbon white oil product. In general, it may be desired to recover various fractions of the hydrocarbon white oils from the hydrocarbon white oil phase in order to make the hydrogenation process economically attractive. This recovery step can be accomplished in any suitable manner known to the art such as by passing the hydrocarbon white oils through a bed of suitable adsorbent material which has the capability to selectively retain naphthenic or paraffinic white oils contained therein or by contacting same with a solvent having a high selectivity for either the paraffinic or naphthenic white oils or by a suitable fractionation scheme where feasible.

It should be noted that while the vast majority of the hydrogenation reaction zone is a stable white oil hydrocarbon, a very small quantity of aromatics such as naphthalene and alkylbenzene remain. However, these impurities are typically only present in amounts less than 500 ppm and, depending upon hydrogenation reaction zone conditions and catalyst, the components are present in amounts less than 250 ppm respectively. It should further be explained that the use of a catalyst comprising a surface-impregnated platinum group metal component results in a white oil product with less naphthalene and alkylbenzene than the white oil product of a hydrogenation reaction zone comprising a uniformly impregnated platinum group metal component.

The following examples are introduced to further describe the process of this invention. The examples are intended to be illustrative embodiments and are not intended to restrict the otherwise broad interpretation of the invention as set forth in the claims appended hereto.

EXAMPLE 1

Two catalysts, both of this invention, were prepared as set forth below. Both catalysts were prepared using gamma-alumina spherical particles having a diameter of approximately ⅛" to 1/16". Besides comprising gamma-alumina, Catalyst A comprised uniformly impregnated platinum and Catalyst B comprised a surface-impregnated platinum component.

The alumina spheres were prepared by the well known oil drop method. The aged and washed spheres were then dried for 30 minutes at from 120°–230° C. The dried spheres were then calcined at a temperature of from 480°–680° C. for a time sufficient to convert the alumina spheres into the gamma-alumina crystalline form. The gamma-alumina spheres were then used to prepare each of the two catalysts as set forth below.

Catalyst A comprises a spherical gamma-alumina base uniformly impregnated with platinum. Catalyst A was formulated by preparing an impregnation solution comprising a 1.0 wt. % solution of HCl with enough $H_2PtCl_6$ to result in the catalyst comprising 0.375 wt. % of uniformly impregnated platinum. The solution was contacted with the gamma-alumina base for 1 hour and then the volatiles were driven off the catalyst in a steam rotary evaporator until the catalyst had an LOI of 45 wt. % at 900° C.

Catalyst B comprises 0.375 wt. % platinum surface impregnated upon a gamma-alumina spherical support. Catalyst B was surface impregnated with platinum by exposing the catalyst particle to a solution containing only enough $H_2PtCl_6$ to result in a catalyst with a total concentration of 0.375 wt. % platinum. Specifically, in formulating Catalyst B, the gamma-alumina catalyst particles were contacted with only a chloroplatinic acid solution, i.e. without HCl addition. The catalyst base is added quickly followed by immediate evaporation of the volatiles in the steam rotary evaporator. This results in the surface-impregnation of the catalyst with platinum. The platinum-impregnated particles were subjected to the same drying and calcining steps as Catalyst A above. Both catalysts were reduced in the presence of hydrogen by first heating to 565° C. in 8 hours, reduction at 565° C. in 1 hour and cooling down in hydrogen rapidly.

EXAMPLE II

Catalyst A and Catalyst B were both analyzed by energy dispersive X-ray spectroscopy (EDX) to determine the platinum distribution throughout each catalyst. The results of the EDX analysis of each catalyst can be found in FIGS. 1 and 2. The platinum distribution of Catalysts A and B as reported in FIGS. 1 and 2 were determined by averaging the results of the EDX analysis of three separate catalyst particles of each of Catalyst A and Catalyst B.

Figure 2:
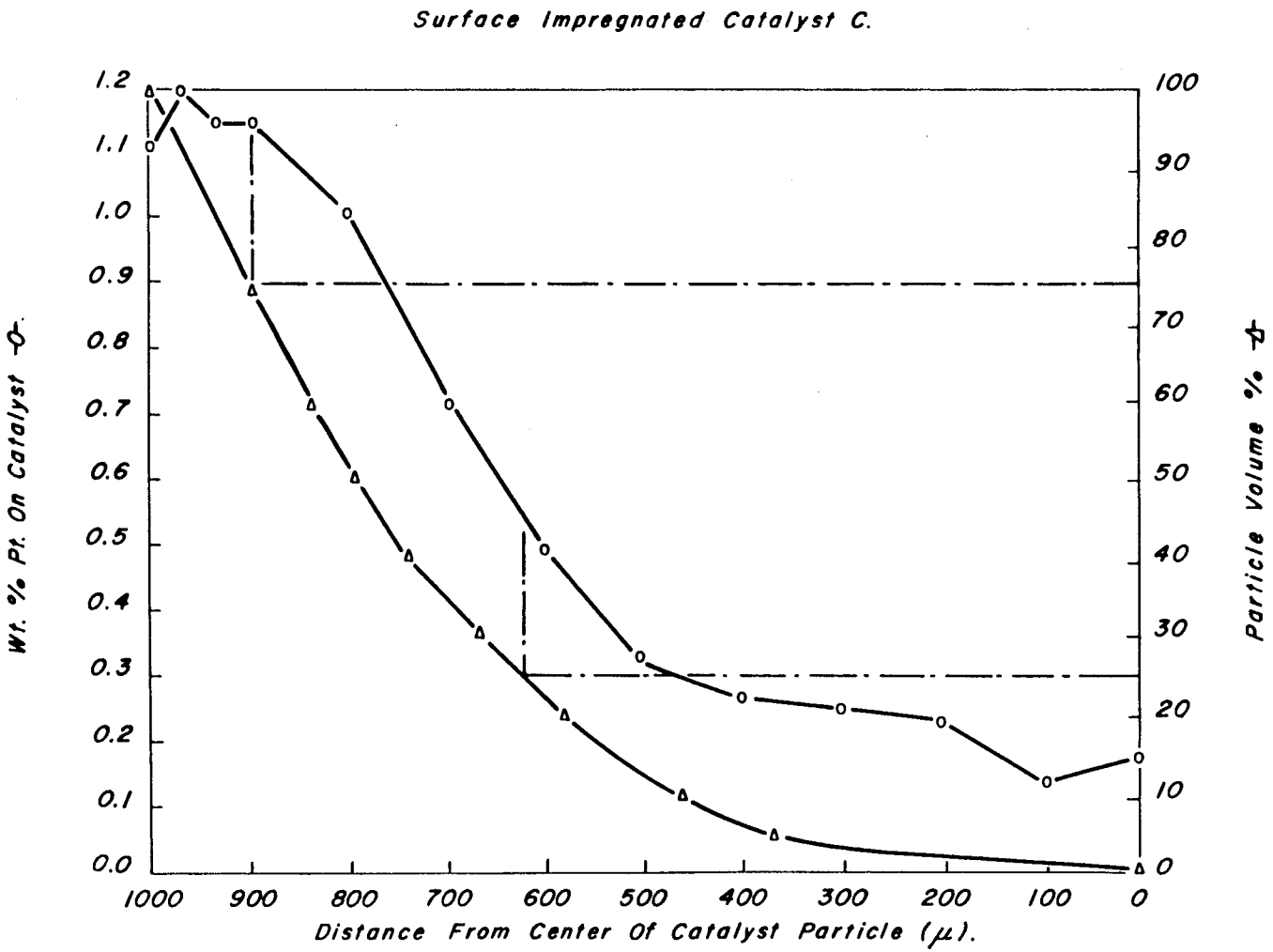
FIG. 2 is a plot similar to FIG. 1. However, in FIG. 2, the catalyst analyzed by EDX spectroscopy was surface impregnated with platinum (Catalyst B). A plot of the platinum distribution across the radius of this surface impregnated platinum-containing catalyst along with the relative volume distribution as a function of distance from the center of the particle of the spherical alumina support can be found in FIG. 2.

FIG. 1, representing Catalyst A, comprising uniformly impregnated platinum obviously indicates that the average concentration of platinum in the outer 25 vol. % of the catalyst particle is essentially the same as the platinum concentration in the innermost 25 vol. % of the catalyst particle. Thus, Catalyst A is truly uniformly impregnated.

The platinum distribution of Catalyst B of this invention is not uniform upon the gamma-alumina particle. The average platinum concentration on the outer 25 vol. % of the average particle is at least 1.15 wt. % while the average platinum concentration on the innermost 25 vol. % of the catalyst particle is at most 0.55 wt. %. Thus, the outer platinum concentration is at least 2 times that of the inner platinum concentration and Catalyst B is surface impregnated according to the definition of this invention.

EXAMPLE III

Catalysts A and B were both evaluated in a pilot plant for their ability to hydrogenate a by-product stream of an aromatic alkylation process. The catalysts were compared in their ability to hydrogenate the hydrogenatable constituents of the feedstock by analyzing the product for the non-hydrogenated product impurities of naphthalene and alkylaromatics.

A 400 cc catalyst/inert material mixture was loaded into the pilot plant reactor. The reaction zone mixture consisted of 200 cc of Catalyst A or B mixed with 100 cc 1/16" alpha-alumina spherical particles and 100 cc sand. The purpose of using the alpha-alumina and sand in the reaction zone was to minimize deleterious hydrocracking of the white oil product by decreasing the reaction exotherm. The reaction zone was operated at a temperature of 200° C., a pressure of 102 atmospheres, a hydrogen-to-hydrocarbon feed ratio of 10:1 and a liquid hourly space velocity of either 0.4 or 0.2. The reactor was operated in a down-flow operation mode.

The feedstock to the pilot plant reaction zone was a heavy by-product of an aromatic alkylation process in which benzene is alkylated with $C_{10}$–$C_{14}$ straight chain olefins. The feedstock is characterized in Table 1 below. A separate mass spectrometer analysis of the feedstock indicated it comprised about 90 wt. % aromatics and 10 wt. % paraffins.

TABLE 1

| Hydrogenation Zone Feedstock Characterization | |
|---|---|
| Bromine Number | 1.0 ± 0.3 |
| Flash Point, ASTM D93, °C. | 202 |
| Pour Point, ASTM D97, °C. | −46 |
| Freeze Point, ASTM D2386, °C. | <−54 |
| Aniline Point, ASTM D611, °C. | 55.2 |
| Kinematic Viscosity, cSt, ASTM D445 | |
| at 38° C. | 25.49 |
| at 50° C. | 15.70 |
| Linear Alkylbenzenes, Mass % | 7.8 |

TABLE 1-continued

| Hydrogenation Zone Feedstock Characterization | |
|---|---|
| Distillation, Type: ASTM D2887 | |
| I.B.P., °C. | 324 |
| 5% | 351 |
| 10% | 358 |
| 20% | 366 |
| 30% | 372 |
| 40% | 378 |
| 50% | 384 |
| 60% | 392 |
| 70% | 402 |
| 80% | 417 |
| 90% | 437 |
| 95% | 457 |
| E.P., °C. | 508 |

The results of the pilot plant testing of Catalysts A and B can be found in Table 2 below:

TABLE 2

| | Catalyst A | | Catalyst B | |
|---|---|---|---|---|
| LHSV, $hr^{-1}$ | 0.4 | 0.2 | 0.4 | 0.2 |
| Naphthalene, ppm | 30 | 20 | 25 | 15 |
| Alkylbenzene, ppm | 365 | 225 | 260 | 145 |
| UV Absorbance (280–360 ppm) | .106 | .110 | .090 | .077 |

The results indicate that both catalysts are able to produce a white oil product with a good UV absorbance and low alkylbenzene and naphthalene content. However, the surface-impregnated platinum Catalyst B produces a white oil product that is slightly superior in UV absorbance, that is, a lower naphthalene, and alkylbenzene content to that of the uniformly impregnated platinum Catalyst A.

By way of review, UV absorbance is a measure of the amount of polynuclear aromatics contained in the white oil product. To determine the amount of polynuclear aromatics in a white oil product, a product sample is evaluated for UV absorbance at four wavelength ranges: 280–289, 290–299, 300–329, and 330–359. The typical white oil must contain less than 0.1 ppm of polynuclear aromatics at any of these four wavelength ranges. However, the data reported in Table 2 for UV absorbance is the total ppm of polynuclear aromatic in the entire wavelength range of 230–360.

Obviously from the UV absorbance data, Catalyst B is also better at converting polynuclear aromatics to a white oil product than Catalyst A. However, it should be noted that the white oil product of both catalysts conforms to white oil product UV specifications.

What is claimed is:

1. A single reaction step hydrogenation process for producing a hydrocarbon white oil which process comprises contacting a feed stream comprising $C_{15}$–$C_{50}$ hydrocarbons obtained directly from an aromatic alkylation process without any intermediate hydrotreating steps for the purpose of removing sulfurous components with a hydrogenation catalyst comprising a platinum group metal component that has been surface impregnated upon an alumina support to form an alumina catalyst particle in such a manner that the concentration of the platinum group metal on the outer 25 volume percent [vol. %] of the alumina catalyst particle is at least twice as great as the concentration of the platinum group metal component on the inner 25 volume per cent [vol. %] of the alumina catalyst particle with the contacting occurring in a hydrogenation reaction zone operating at a temperature of from 125° to 300° C., a pressure of from 10 to 150 atmospheres, a liquid hourly space velocity of from 0.05 to 5 $hr^{-1}$,and a hydrogen-to-hydrocarbon molar feed ratio of from 2 to 15, and recovering the white oil produced in the hydrogenation reaction zone.

2. The process of claim 1 further characterized in that the catalyst particle is a sphere or an extrudate.

3. The process of claim 1 further characterized in that the $C_{15}$–$C_{50}$ hydrocarbon feedstock comprises from 70 to 100 wt. % alkylaromatic hydrocarbons and from 0 to 30 wt. % paraffinic, and 0 to 30 wt. % olefinic and naphthenic hydrocarbons.

4. The process of claim 1 further characterized in that the platinum group metal component is present in the catalyst in an amount ranging from 0.05 to 5.0 wt. %.

5. The process of claim 4 further characterized in that the platinum group metal component is platinum.

6. The process of claim 5 further characterized in that the hydrogenation catalyst comprises an alkali group metal component.

7. The process of claim 6 further characterized in that the alkali group metal component is selected from the group sodium, potassium, lithium, or mixtures thereof.

8. The process of claim 7 further characterized in that the alkali group metal component selected from the group sodium, potassium, lithium, or mixtures thereof is present in the catalyst in an amount ranging from 0.1 to 5.0 wt. %.

9. A hydrogenation process for producing a hydrocarbon white oil which comprises contacting a feed stream which is essentially free of sulfur and which comprises 70 to 100 wt. % alkylaromatic and 0 to 30 wt. % paraffinic, olefinic and naphthenic $C_{15}$–$C_{50}$ hydrocarbons obtained from an aromatic alkylation process with a hydrogenation catalyst comprising from 0.05 to 5.0 wt. % of a surface-impregnated platinum component and from 0.1 to 5.0 wt. % of a lithium, sodium, or potassium component on a gamma-alumina support particle where the surface-impregnated platinum is located on the gamma-alumina particle in such a manner that the platinum concentration on the outer 25 vol. % of the gamma-alumina catalyst particle is at least twice that of the platinum concentration in the inner 25 vol. % of the gamma-alumina catalyst particle with the contacting occurring in a hydrogenation reaction zone operating at hydrogenation reaction conditions including a temperature of from 125° to 300° C., a pressure of from 10 to 150 atmospheres, a liquid hourly space velocity of from 0.1 to 5.0 $hr^{-1}$, and a hydrogen-to-hydrocarbon molar feed ratio of from 2 to 15 and recovering the white oil product produced therefrom.

10. The process of claim 9 further characterized in that the hydrogenation reaction occurs in a mixed phase of gas and liquid.

11. The process of claim 9 further characterized in that the catalyst support particle is spherical or an extrudate.

* * * * *